US007882675B2

(12) United States Patent
Lundgren

(10) Patent No.: US 7,882,675 B2
(45) Date of Patent: Feb. 8, 2011

(54) GLAZING SYSTEM FOR BUILDINGS

(76) Inventor: Jerker Lundgren, Loggatan 28B, Örebro (SE) S-702

( * ) Notice: Subject to any disclaimer, the term of this patent is extended or adjusted under 35 U.S.C. 154(b) by 1022 days.

(21) Appl. No.: 10/501,809

(22) PCT Filed: Jan. 17, 2003

(86) PCT No.: PCT/SE03/00070

§ 371 (c)(1),
(2), (4) Date: Jul. 20, 2004

(87) PCT Pub. No.: WO03/062579

PCT Pub. Date: Jul. 31, 2003

(65) Prior Publication Data

US 2005/0126090 A1 Jun. 16, 2005

(30) Foreign Application Priority Data

Jan. 21, 2002 (SE) ..... 0200141

(51) Int. Cl.
*E04C 2/38* (2006.01)

(52) U.S. Cl. ..... 52/656.5; 52/235; 52/474; 52/204.62

(58) Field of Classification Search ..... 52/235, 52/474, 476, 204.5, 204.53, 204.593, 204.595, 52/204.597, 204.62, 204.71, DIG. 17, 656.5, 52/656.6, 770, 762, 506.06, 506.08, 481.2, 52/483.1, 489.1
See application file for complete search history.

(56) References Cited

U.S. PATENT DOCUMENTS 3,715,848 A * 2/1973 Jordan ..... 52/235

(Continued)

FOREIGN PATENT DOCUMENTS

GB 2279684 A 1/1995

(Continued)

*Primary Examiner*—Richard E Chilcot, Jr.
*Assistant Examiner*—Jessica Laux
(74) *Attorney, Agent, or Firm*—Lerner, David, Littenberg, Krumholz & Mentlik, LLP

(57) ABSTRACT

Glazing system for buildings, comprising a number of module elements (1) arranged to be joined to parts that are part of a building without intermediate framework. The elements comprises a glass sheet (3) each, which is supported by the frame (18) of the building, by means of supporting elements (22) and is retained in an intended position by means of retaining devices (23) supported by the frame, which retaining devices (23) each one is arranged to be joined with the sheet by means of attachment elements (12). The attachment elements (12) are arranged with organs (38) for coupling the attachment elements to coupling organs (43) on the respective retaining device (23), before being mounted on the building frame, the module elements (1) are arranged with the attachment elements (12) attached, which thus form a handling protection against damages of the edge of the sheet (3). The retaining devices (23) are at the mounting attached to the frame (18) with their coupling organs (43) in positions corresponding to those positions that the coupling organs (38) of the attachment elements (12) of the respective sheet (3) will take when the sheet is positioned in its intended position. The module elements (1) may thus be mounted from the inside of the building part by connecting the coupling organs of the retaining devices with the coupling organs (38) of the respective attachment element (12).

10 Claims, 6 Drawing Sheets

U.S. PATENT DOCUMENTS

| | | | | | |
|---|---|---|---|---|---|
| 3,956,854 | A | | 5/1976 | Yamamoto | |
| 4,809,475 | A | | 3/1989 | Emmer | |
| 4,854,098 | A | | 8/1989 | Emmer | |
| 5,199,236 | A | | 4/1993 | Allen | |
| 5,355,645 | A | * | 10/1994 | Farag | 52/235 |
| 5,590,502 | A | * | 1/1997 | Wendt | 52/489.2 |
| 5,884,361 | A | | 3/1999 | Richardson et al. | |
| 6,098,364 | A | * | 8/2000 | Liu | 52/506.08 |
| 6,170,214 | B1 | * | 1/2001 | Treister et al. | 52/511 |
| 6,289,646 | B1 | * | 9/2001 | Watanabe | 52/506.1 |

FOREIGN PATENT DOCUMENTS

| | | | |
|---|---|---|---|
| NO | 309827 | B1 | 4/2001 |
| SE | 462 291 | B | 5/1990 |

* cited by examiner

GLAZING SYSTEM FOR BUILDINGS

TECHNICAL FIELD

The present invention relates to glazing systems at which glass elements meet each other edge to edge without any visible framing. Such glazing is sometimes referred to as structure glazing.

BACKGROUND OF THE INVENTION

At the above mentioned glazing systems, the glass elements may be in the form of single glass or in the form of sealed glazing units with two or more glass sheets that are stuck to each other with air or gas-filled spaces. At a typical such arrangement with sealed glazing units, the glass elements are constituted by an inner and an outer glass sheet, where the latter shall form the façade surface of the glazing. The two glass sheets are joined together with an intermediate frame, which, at least at the side edges of the glass elements, is indented from these edges, at which a groove from the respective edge thereby is formed. When the glass elements are mounted with the edges of their outer glass sheets adjacent to each other, there shall be slots on the inside between the inner glass elements.

In an assembled condition, the glass elements are supported by the supporting frame of the building, which is situated inside the façade. At the lower edge of the respective glass element, the supporting elements extend from the frame and in under it. At said design with sealed glazing units, the supporting elements extend into said slot, such that the inner glass sheet can rest against the supporting element with its lower edge. In this way, the weight of the glass element supported by the frame via the supporting elements. Besides, it is required that the glass elements are retained that they do not tip and fall outwards or inwards. For retaining the glass elements, attachment elements which are connected with the building frame are provided, which attachment elements extend in over the side edges of the glass elements and grip around these. For the design with double glass sheets, the attachment elements extend in said slot at the side edges of the glass elements and into said groove at these edges, in a position where they grip around the edge of the inner glass sheet. This retaining must resist relatively large forces, especially wind forces, which strive to press the glass elements inwards or pull them outwards.

In order to enable the supporting elements to extend under the respective glass element and to enable the attachment elements to grip around the side edges of the glass elements, it is required that slots are left between the edges of these when the glass elements are made as single glass. For the design with double glasses in the glass elements, slots are required at the edges only for the innermost glass sheets, while the outer may be joined edge to edge.

A typical such a retaining arrangement is disclosed in U.S. Pat. No. 5,199,236 (Allen). In a cross section in the patent document (FIG. 3) through two adjacent side edges of two glass elements, the above mentioned embodiment with grooves that extend inwards from the side edges of the glass sheets to the joining frame element is apparent. In a slot between the edges of the two inner glass sheets, the retaining elements extend, which are joined with the building frame, which is shown in the form of a shaped hole beam. It is desired that the slot between the outer glass elements is as small as possible, partly to render the joint as little visible as possible and partly to decrease the consumption of sealing compound in the joint during sealing of a mounted façade and also to reduce the amount of work for application of said sealing compound after the glass elements have been mounted. For sealed glazing units this may be achieved by means of a design where the edges of the outer glass sheet are protruding in relation to the inner, where there has to be a slot for the insertion of the supporting and retaining elements. This presumes, however, that a broad outer slot does not have to be arranged in order to provide access to, for example, the attachment elements from the outside during mounting.

At the attachment elements, which shall grip around the edge of the glass sheet, there is a risk that the edge is broken if the mounting is too rigid. Should such breakage occur, and the risk is especially large when large wind forces appear, this may result in that the glass element tips outwards and, falls down, which, of course, is a catastrophe. The risk for the occurrence of this increases with the size of the glass element. Large elements are often desired, due to the fact that these have a lesser length for outer joints and due to the fact that the supporting frame on the inside may be made to be more free. The latter is especially interesting with so called outrigged systems, where the frame does not constitute an actual building part, but only has the function to support a glass wall. In order to provide for this wall to stand as freely as possible, the frame is thus made with beams and sometimes also with firmly tightened steel wires at a distance from the inner glass surface and joining the frame and the supporting and attachment elements of the glass elements with supports.

DISCLOSURE OF INVENTION

The purpose of the present invention is to achieve a retaining of the glass elements. The device shall thus provide for two functions: Carrying the weight of the glass elements and retaining the elements against tipping movements outwards from the frame and inwards against the frame. This shall be achieved by means of retaining devices comprising attachment elements, which provide for a flexible mounting with respect to the inner glass sheet, such that the attachment elements are provided with such a flexibility against deformations, for example bending and small movements of the glass elements, that a breakage of the glass edge may be avoided. By means of the invention there is also achieved a simple mounting and a possibility to make the joints between the glass elements very thin as no inner parts have to be accessible from the façade during mounting. The system according to the invention also provides good opportunities for outrigging of glass walls from the supporting frame.

These purposes of the invention are achieved by means of a retaining device comprising attachment elements, which are joined with the edge of the glass sheet before the mounting of the glass elements and which provide a certain flexibility between the glass sheet and the attachment element. The attachment element is in turn supported by a device for connection with a building frame, which allows a certain, accurately controlled movement between the supporting frame and the attachment elements and thus also for the glass elements. Both the attachment element and the retaining device are more apparent in the following description of embodiment examples.

BRIEF DESCRIPTION OF DRAWINGS

In the following, a preferred embodiment of the glazing system according to the invention is described, which relates to a design with the glass elements made as sealed glazing units with double glass sheets. In the following, it is referred to the appended drawings, where.

PREFERRED EMBODIMENT

The glazing system according to the invention for mounting building façades or glazings and roofs to spaces are primarily assembled by sheet-shaped module elements, in the illustrated figures designated with 1. Each module element comprises an outer sheet 2 and an inner sheet 3. They have thus the form of a sealed glazing unit. Preferably, the surface of the module elements 1 is rectangular or square and mounted on a building frame with a horizontal lower and upper edge and with vertical side edges. The elements are mounted with their edges beside each other, such that the larger surface that is required in order to form a façade or a glazing part, is formed. Even if it is assumed here that the elements are perpendicular, when building glazing systems according to the invention, it is not excluded that elements of other forms may be used, for example triangular or polygonal, either solely or in combination with perpendicular elements. In a façade or a glazing there may also be elements such as doors, openable windows or wall-parts made in different building materials.

It is here also assumed that the module elements are joined by glass sheets, which does not exclude that instead of sheets of glass, sheets of another material may be used, for example plastic. As mentioned in the introduction, the elements may be made as single glass or as sealed glazing units with two or more glass sheets with spaces intermediate. All such deviations from which is described here as a preferred embodiment, fall within the scope Glazing System of the invention. Since glass is the dominating material in the present context, the terms Glazing System, Glazing and Glass Element, Glass sheets are used in the following in this description.

Figure 3:
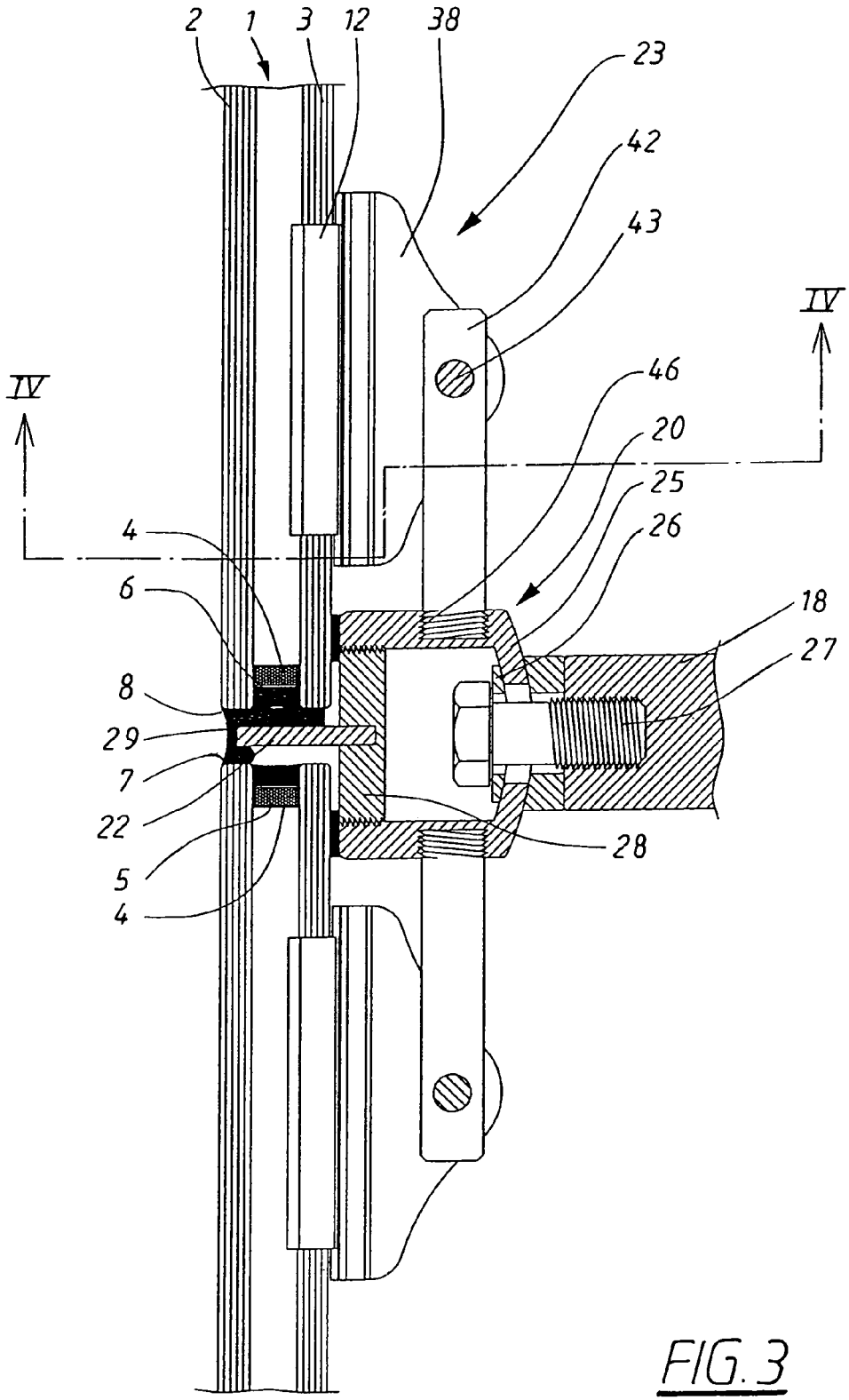
FIG. 3 shows a vertical section of the part shown in FIGS. 1 and 2 and extending along the line III-III in FIG. 4.
Figure 4:
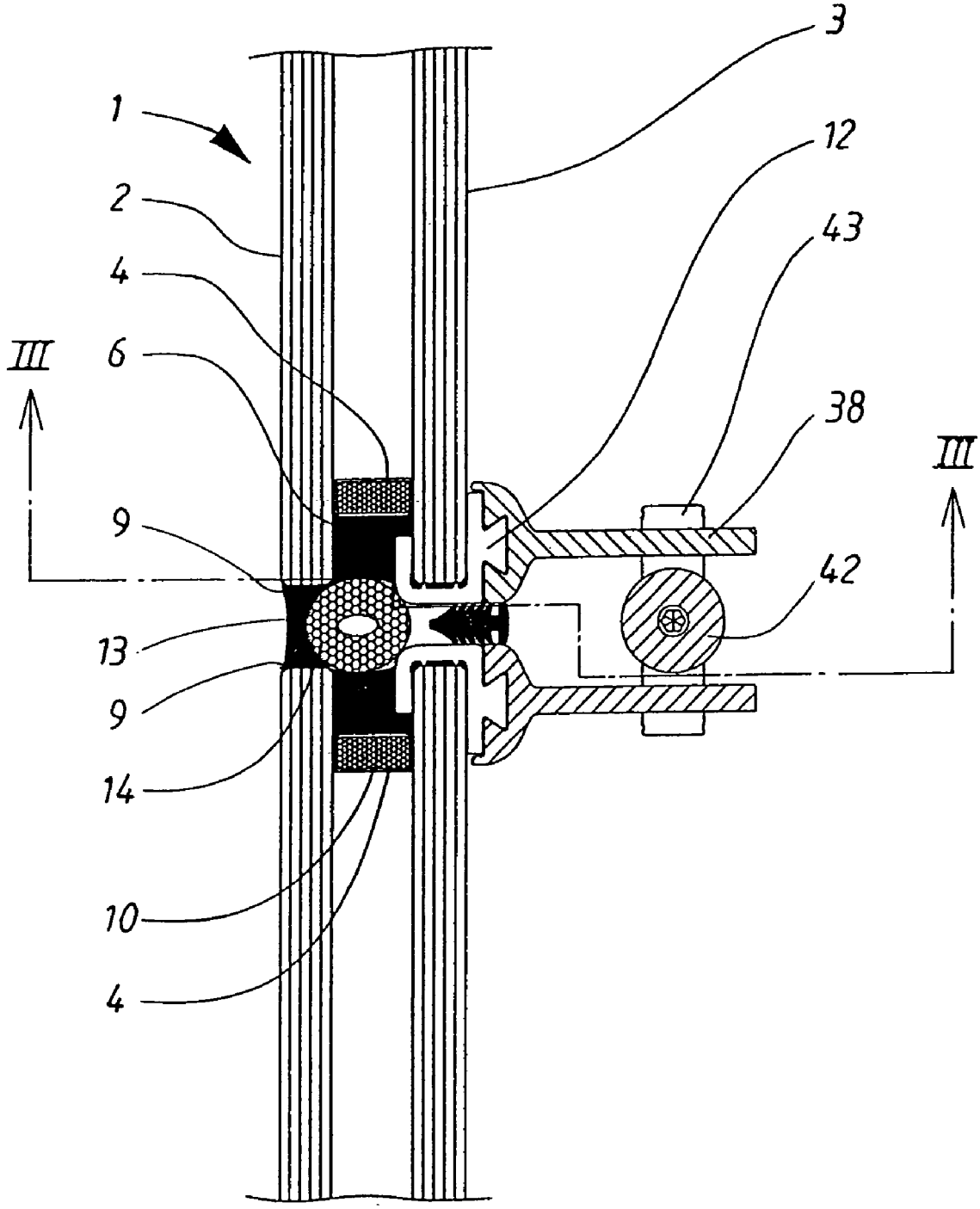
FIG. 4 shows a horizontal section of the part shown in FIGS. 1 and 2 and extending along the line IV-IV in FIG. 3.

Each glass element 1 is at this described embodiment composed by an outer glass sheet 2 and an inner glass sheet 3, which are joined by means of a framework 4, which extends along the edges of the element. As shown in FIGS. 3 and 4, the profiles of the frame work 4 are indented from the edges of the glass elements 2, 3, such that grooves 5 (FIG. 3) respective 10 (FIG. 4) are formed, which extend inwards from the edges of the glass element, into the surface of the framework that faces outwards. For adhering the glass sheets to the framework, the grooves 5, 10 are filled with a compound 6 which adheres to the glass surfaces, preferably a silicon compound is used. It is also suitable that the framework 4 is adhered to the glass surfaces by means of a gluing substance which also may be based on silicon. As is apparent from FIG. 3, which shows a vertical section, the edges of the glass sheets 2, 3 are in level with each other at the upper edge of the glass element, in the figure designated with 7, and with its lower edge designated with 8. As is apparent from FIG. 4, the same is true for the side edges 9 of the elements. Here, however, the framework 4 is more indented from the side edges 9 of the glass sheets 2, 3, making the grooves 10 deeper than the grooves 5 of the upper and lower edges 7, 8. The reason for this is that at the side edges 9, attachment elements 12 shall have room to extend in around the inner side edge of the glass sheet 3 and into the groove 10. It is thus possible that the side edges of the outer glass sheet 2 are allowed to extend further out from the frame work than the edges of the inner glass sheet 3, in order to provide space for the attachment elements 12 not making it necessary to have the same width between the side edges of outer glass sheets 2 therefore. At glazings of this glazing type mentioned in the introduction, it is desired to have as unbroken façade or glazing surfaces as possible, which makes it desirable to have the joints between the glass elements as thin as possible. It is, however, not possible to avoid the appearance of a slot between the edges of the outer glass sheets in order to allow movements due to heat or other causes to be absorbed, such that the glass sheets are not exposed to pressure tensions and not glass against glass contact either, which is not suitable. If the building part that is made by the glass elements shall form a dens wall, which always is the case when the part constitutes an outer façade or a roof, said slots are filled with a compound 13, which is elastic and may absorb said movements. This compound is inserted after mounting of the glass elements and may be supplemented with distance organs 14 (FIG. 4) in order to reduce the need of the sealing compound 13, where larger spaces occur, which especially is the case at the side edges 9, where said space for the attachment elements 12 shall be ensured.

For supporting the glass elements, these have to be connected with the frame of the building. At façade glazings this is usually a building frame that is arranged with floor levels between which spaces are formed. The façade may thus closely attach to the building frame. At glazings, where a space completely or partly is to be confined by glass walls shall be done, the main task of the frame is to support these glass walls made by glass elements. Usually, the frame thus consists of an open beam system. In order to give the glazing a character that is as open as possible, it occurs that this beam system is positioned at a distance from the glass walls, preferably on the inside. Thus, distance organs are required for support of the glass elements, which distance organs extend between the frame and the glass elements, while, at the façades that have been mentioned, the glass elements may be firmly established close to the building frame. The glazing system according to the present invention is arranged to be adapted to both the mentioned cases and provides extraordinary possibilities to build glazings with a distance between the glass wall and the frame, so called outrigged systems.

Figure 1:
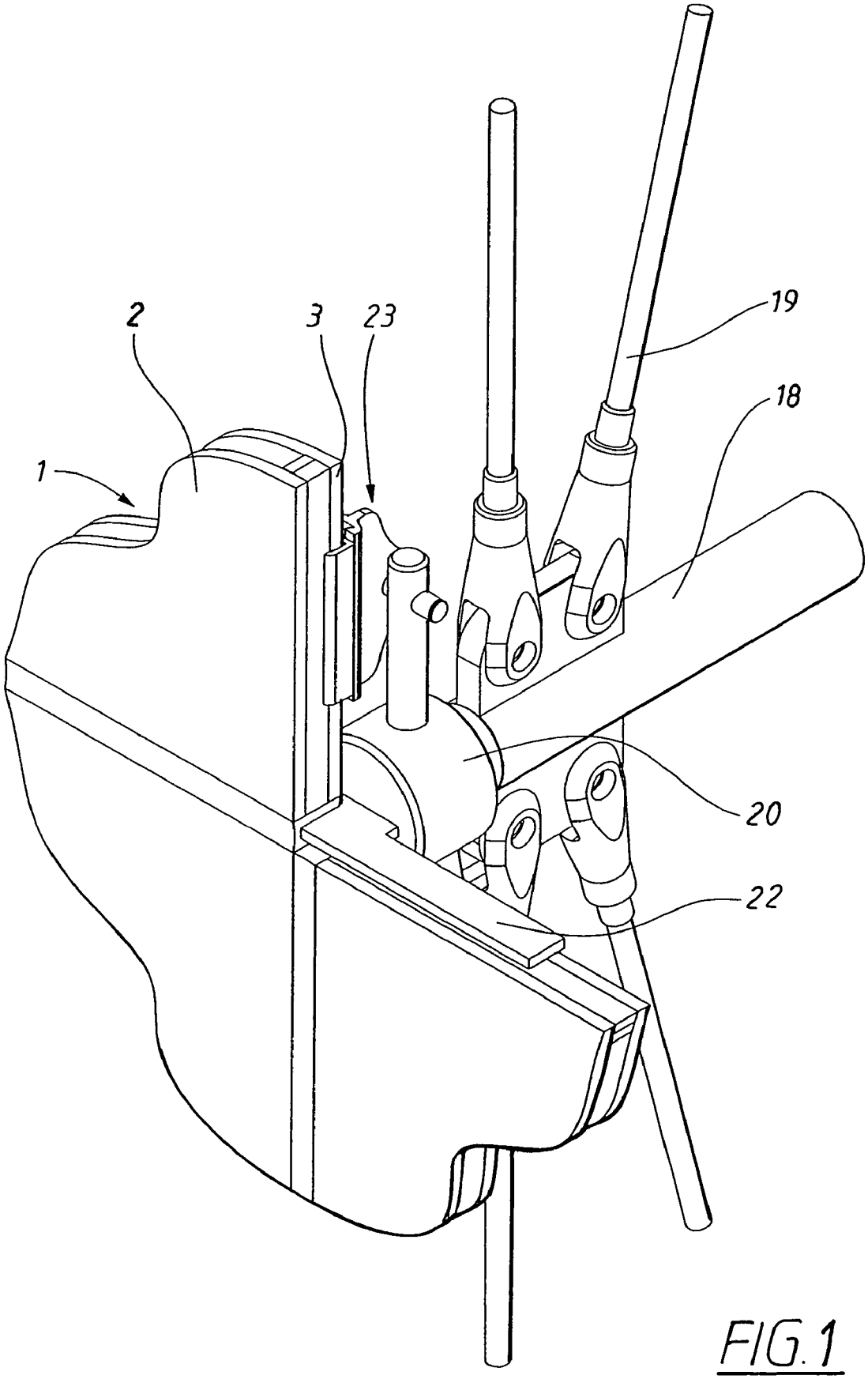
FIG. 1 shows a perspective view of a part of the glazing system from its outside at which four glass elements meet, with some parts of the view omitted in order to increase the clearness.
Figure 2:
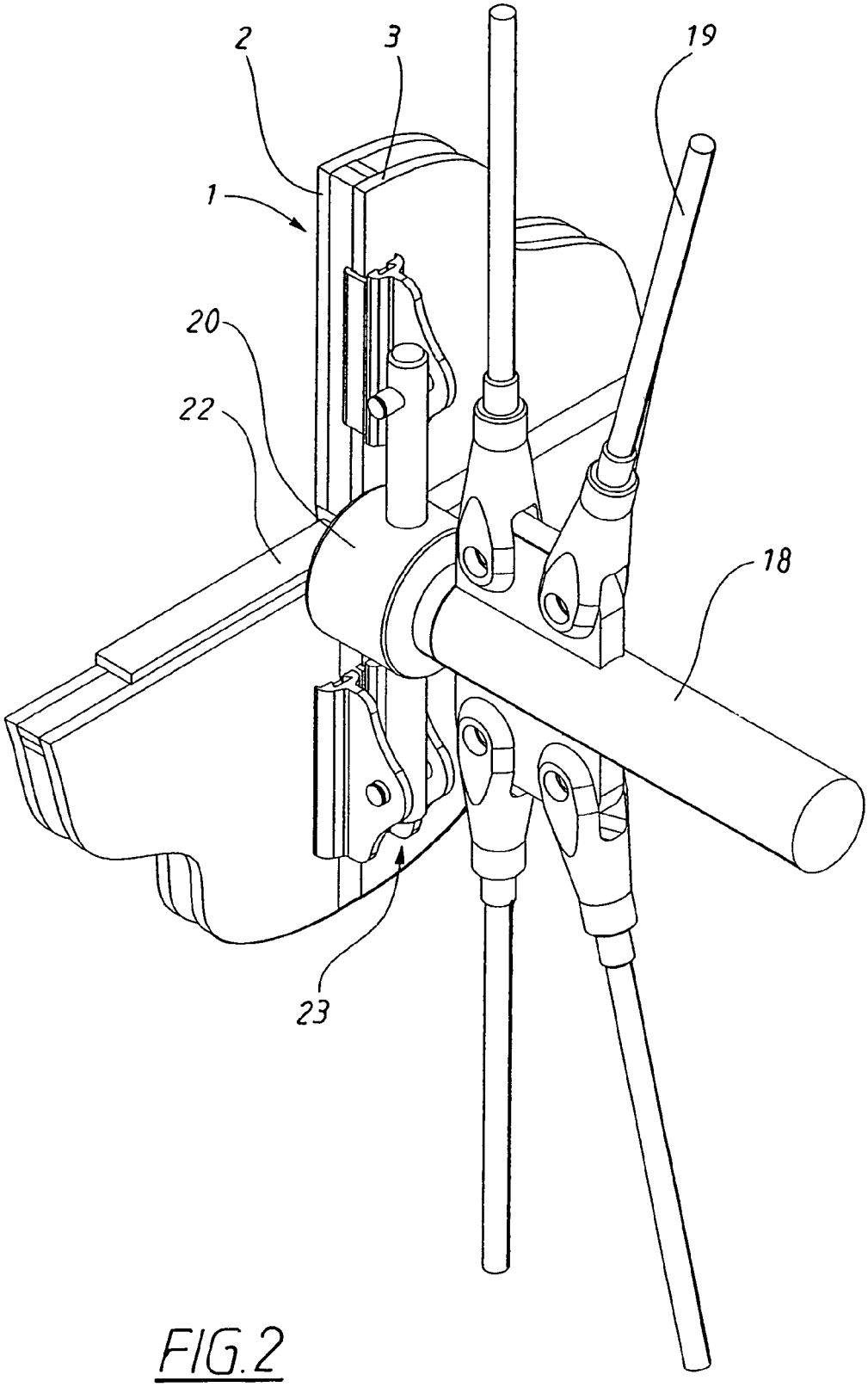
FIG. 2 shows a perspective view of the part shown in FIG. 1, but seen from the inside of the glazing system, here also some parts are omitted.

In the following, the specifics of the invention will now be described, which mainly relate to the device for connecting the glass elements with the building frame. As mentioned, the device shall provide for two functions: Absorbing gravitational forces due to the glass element's own weight, and retaining the elements from tipping movements outwards from the frame and inwards against the frame. The connection shall thus allow certain movements between the glass elements and the frame; with a too rigid connection, breakage in the glass elements is risked. A rod-shaped distance element 18 shown in FIGS. 1-3 is used as an element for transmission of forces from the glass elements to the building frame. At the embodiment shown, it is thus assumed that the frame, which is intended for glazing of said outrig type, consists of beam structure, which is positioned at a distance inside the glass wall that is formed of the glass element. This frame is not shown in the figures, but it is assumed to be positioned on the right hand side of the rod-shaped distance elements 18. The distance elements emanate from the building frame and may in this context be considered to represent the firm structure of the building frame. In order to make the distance elements as slender as possible, they are, as shown in FIGS. 1 and 2, braced by means of steel wires 19, which extend between the distance elements and up to the frame. At building façades such an outrig is usually not occurring, and in such cases the distance elements 18 may be substituted by attachments which are intended to be screwed to or integrally casted with the building frame and which may have a part for connection to and support of the glass elements, which mainly corresponds to the outer edge of the distance element 18 (on the left in FIGS. 1-3), in the following called the connection unit 20. The connection unit 20 is arranged to support partly a supporting element 22 for absorbing the weight of the glass element 1 and partly a retaining device 23 for absorbing forces inwards against and outwards from the elements.

The supporting element 22 emanates from the edge of the supporting unit 20 and in the design shown in the figures it has the shape of a plate, which is cut into the edge surface of supporting unit 20. According to FIG. 3, the end of the supporting unit 20 has the shape of a cup-shaped head 25 which has an inner bottom 26 that is retained at its end by means of a screw 27 that is threaded into the distance element 18. This design provides good opportunities to adjust the angular position of the supporting element 22. At the open end of the head, there is a thread into which a sheet 28 is screwed, into which sheet 28 the supporting element 22 is cut. By allowing the supporting element to extend into grooves in the head 25, the sheet 28 may be locked in its thread. The embodiment shown is, however, only an example of the design of the connection part. For absorbing the weight of the overlying glass element 1, its lower edge 8 is placed against the supporting element 22 via an elastic insert 29.

Figure 5:
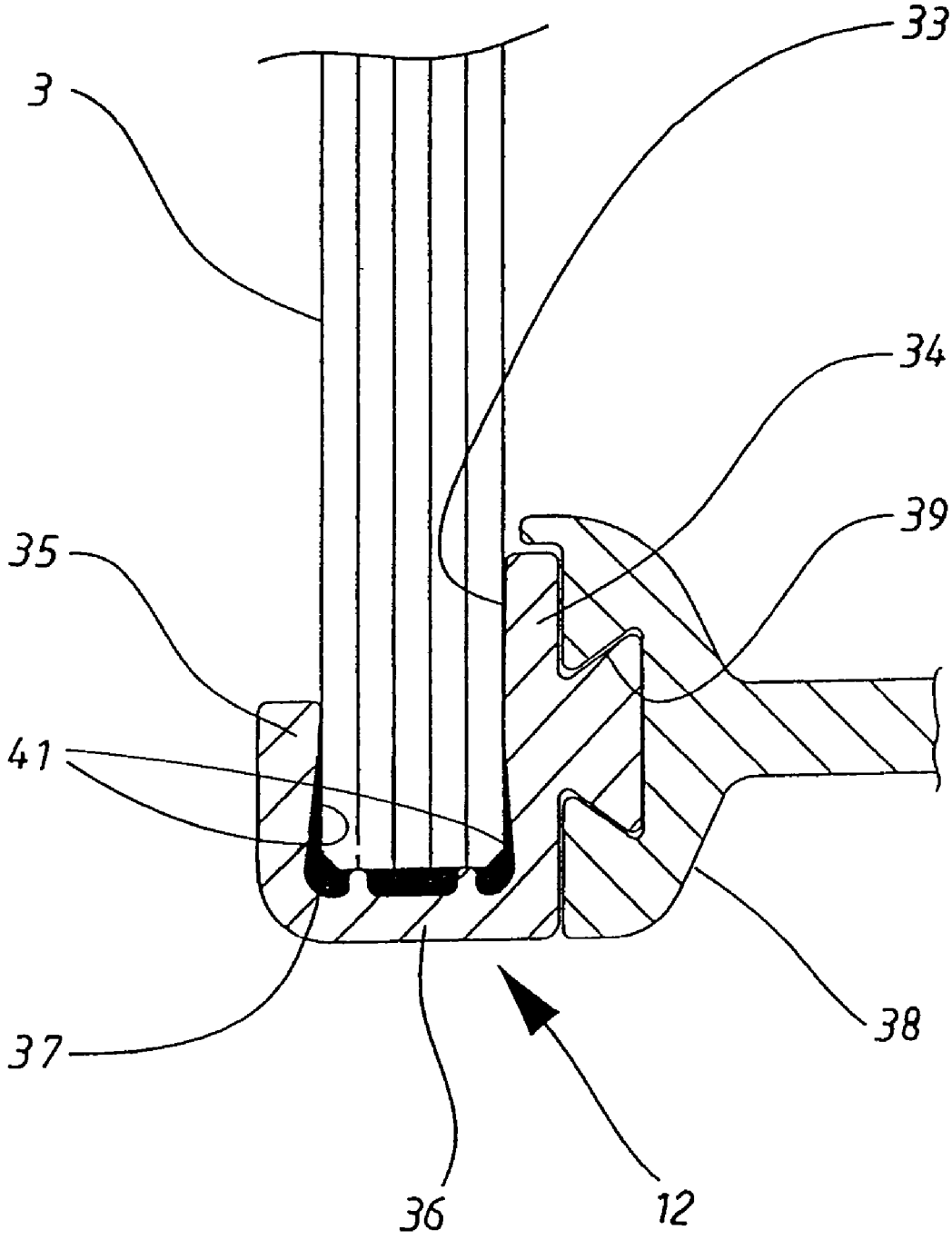
FIG. 5 shows a partial section along the line IV-IV in FIG. 4 with details reproduced in a greater scale than in FIG. 4.

The retaining device 23 extends between the connection unit 20 and respective attachment element 12, which grips over the side edge 9 of the inner glass sheet 3. The attachment element is shown more in detail in the section 7 in FIG. 5. It is made with a groove 33 in which the edge of the glass sheet 3 may be inserted. The groove is formed between a main part 34 of the attachment element and a flange 35 which is bent inwards, which flange 35 joins with the main part 34 with a waist 36. The flange 35 is made in such way that its outer part is curved inwards towards the surface of the glass sheet such that the edge of the sheet has a wedge-shaped play 41 at the inner parts of the main part 34 and the flange 35. The flange 35 and waist 36 are dimensioned to be able to spring, thus preventing a present angular movement between the edge of the glass sheet and the attachment element from causing such forces that could result in a breakage in the edge of the glass sheet. In the groove 33 between the main part 34 and the flange 35, an elastic compound 37 is inserted. This compound fills a play between the glass surface and the surface of the attachment element and also provides a soft contact surface between the glass surface and the attachment element, which is assumed to be made of a relatively rigid material such as hard plastic or metal, and also retains the attachment element at the glass sheet. By means of, the play 41 at the inner part of the groove 33 and said springing ability, the edge of the glass sheet may thus turn somewhat in both directions in the groove by using the play at the inner part of the groove, where said compound is compressed, and by means of the outwards springing of the outer edge of the flange. Within a certain turning angle between the attachment element and the edge part of the glass sheet, contact is maintained between the hard attachment element and the sheet along the edge line at a distance from the edge of the sheet. Thus the risk for exposing the glass sheet to such breaking forces that it brakes at its edge is reduced. A coupling organ in the form of an attachment handle 38 is shown to to the main part 34 of the attachment element 12 as said attachment handle 38 is provided with an angled part that is shown inserted into a dovetail slot 39 in the attachment element and also may be fixed against displacement by means of for example one or more stop screws.

Figure 7:
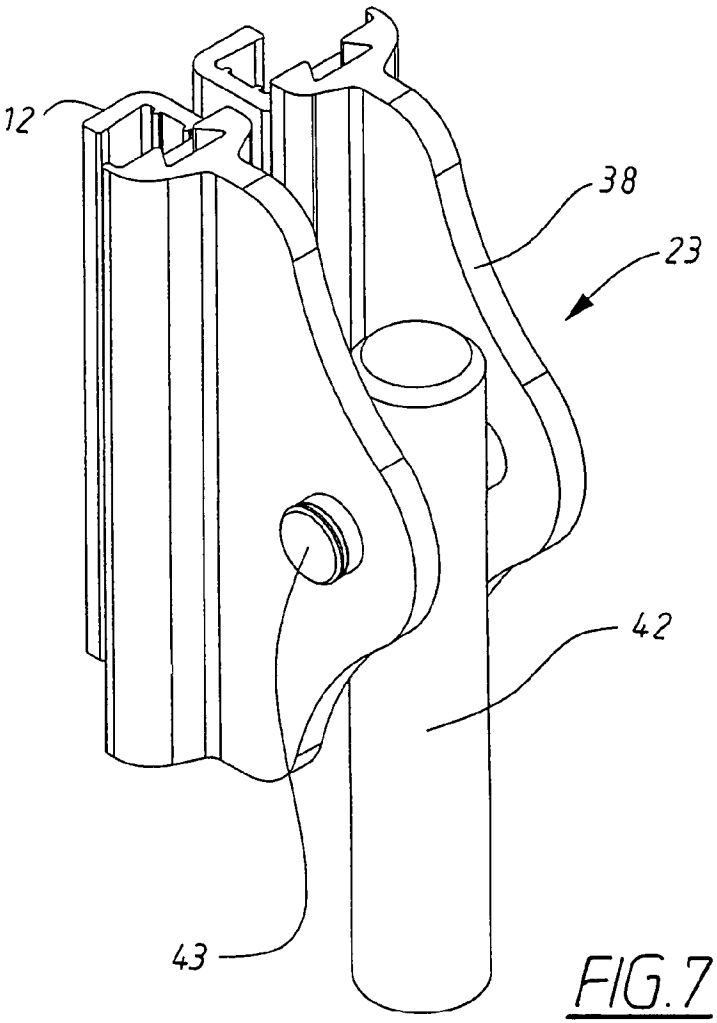
FIG. 7 also shows the retaining device, but from the inside of the system.
Figure 6:
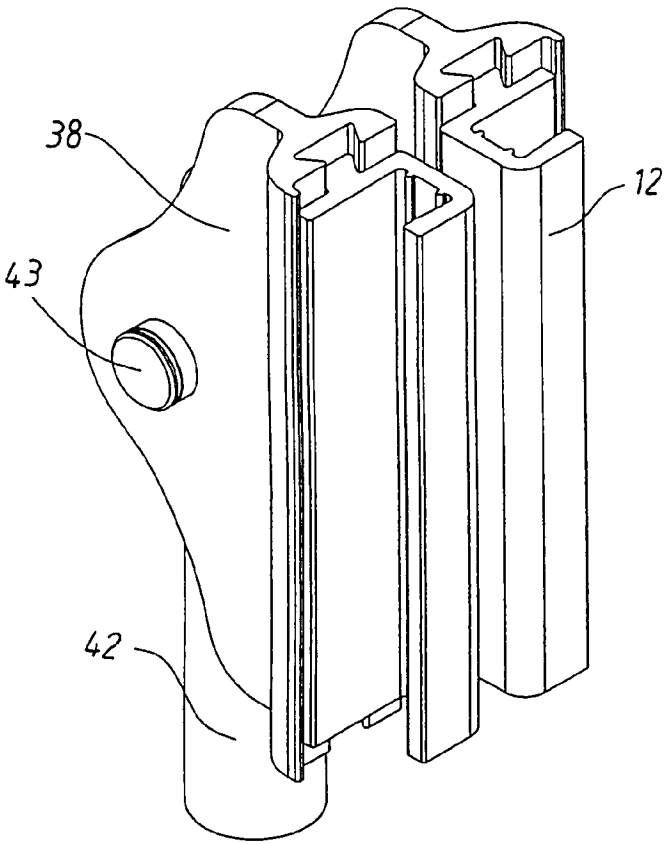
FIG. 6 shows a perspective view of a retaining device from the outside of the system, which device also partly is apparent in a smaller scale in FIGS. 1 and 2.

The attachment element 12 shall be connected with the frame via the attachment handle 38 via the connection unit 20 by means of the retaining device 23. As apparent from especially FIGS. 3 and 7, the attachment handle 38 is thus, together with an attachment handle belonging to an opposed attachment element at the side edge of the opposed glass sheet 3, connected with an arm 42 via an axis 43, that extends through holes 44 the two attachment handles. The arm 42, which thus is connected with the inner glass sheets 3 of two adjacent glass elements, via the attachment elements 12 and the attachment handles 38 and the axes 43, shall be connected with the building frame via the connection unit 20 for retaining the glass elements. According to FIG. 3, this is accomplished due to the fact that the arm 42 and an opposing arm, also designated with 42, have been connected with the head 25 of the distance element 18 by means of a thread joint 46. This head thus constitutes a mounting unit for all organs, which are required for support and retaining of four glass elements which meet in the part described, namely the organs the supporting element 22 and the retaining device 23. For this embodiment, there are large possibilities to introduce organs for position adjustment, thus enabling exact adaptation of the organs that shall be connected with each other to take place before the demanding mounting of the glass elements.

For the design that has been described, it is assumed that each glass element is equipped with two attachment elements 12 on each side edge 9 of the glass sheet 3 (FIG. 4) and relatively close to the corners of the glass sheet (see FIG. 1). The design with the retaining device 23 made as a distance organ between the connection unit 20 and the attachment element 12 enables, however, that the attachment places for the attachment elements may be chosen freely in order to obtain the most advantageous power absorption for different installations. The retaining devices 23 may also be made for retaining of several attachment elements 12.

By in this way collecting all the organs, which are required for support and retaining of the glass elements, to the points where the corners of the four glass elements meet, the least possible number of connections between the glass elements and the building frame is required over continuous surfaces. This is very advantageous, especially at outrigged systems where one desires to have the glass wall as free from the requisite beam frame as possible.

When building a glass wall of the kind that has been described with sealed glazing units, one starts with glass elements 1, which have been produced by means of joining of the two glass sheets 2 and 3 via the frame work 4 and the uniting compound 6. The interspace, that is formed between the glass sheets, provides heat and noise isolating properties to the wall. These may be enhanced by inserting a suitable gas in the interspace and/or by coating the glass surfaces with a heat regulating layer. Preferably each glass element is provided with four attachment elements 12 on its inner glass sheets 3 at the example shown. As mentioned, every glass element may, however, by change attachment devices with several attachment elements, which may be required for very large glass elements. Attachment takes place by means of the compound 37 that has been inserted in the play between the groove 33. If the attachment elements are mounted before transport to the building site, they form a certain protection for the edges of the glass surfaces at transport and handling.

Before mounting of the glass elements takes place, the supporting frame is completed by supplying it with the prescribed connection units 20, which either are mounted directly on the building frame or via distance elements such as the elements 18. After this completion, the connection units shall be equipped with the supporting elements 22 and the arms 42 of the retaining devices 23. When the glass elements shall be mounted on the prepared frame, the attachment handles 38 are first mounted on the pre-mounted attachment elements 12 and are fixed to these. Letting the attachment elements 12 be equipped with attachment handles previously than immediately before mounting should make the glass elements unnecessarily bulky at transport and bring risks for breakage in the glass edge due to strokes against the protruding attachment handles. The glass elements are now ready to be lifted up to placement on each supporting element 22 and turning, such that the arms 42 are fitted between the attachment handles 38 and the axes 43 may be inserted into respective attachment handle 38 and through the arms 42, and also fixing in the same. By enabling movement in a vertical direction between the retaining device 23 and the attachment element 12, mounting tolerances between the position for the attachment handles 38 and the attachment element 12 may be absorbed. This may be achieved by means of displaceability in the joint with the dovetail slot 39.

As stated, the described embodiment example relates to the use of glass elements with two glass sheets, an inner and an outer, at a distance from each other. The glass element is then provided with an enhanced heat and noise absorption ability in relation to single glass. This may be further enhanced by means of sheets or isolation material between the inner and outer sheet. As space for support and attachment elements only is needed between the edges of the inner glass sheets, one may, by making the outer glass sheets larger, obtain very thin slots between them. This is advantageous if the glass wall shall be sealed in the way described. Therefore, the shape that has been described is the most advantageous for façades, glazings and roofs, when a wall between exterior and interior is needed.

In other cases, such as when one wishes to separate different indoor spaces from each other, a design with a single glass may be sufficient. Such a design, that also is comprised by the invention, is based on the same principle for support and retaining as for the embodiment that has been described. The glass sheet at single glass design shall thus function in the same way as the inner sheet at the multi-glass design, in other words to be supported and retained by the connections with the building frame.

The slots between the edges of the elements have to be adapted to provide space for the support and retaining elements, and cannot be reduced in the way described which is possible for glass elements that also are provided with an outer sheet. On the other hand, for interior walls sealing of the slots may be dispensed with in many cases.

When mounting the glass elements, no mechanical work has thus to be made from the outside of the glass wall. After lifting up the glass elements on their supports and turning them to the decided position, only mounting of the axes 43 from the inside is required for performing retaining. Thus, an important object of the invention is fulfilled, namely to make the glazing system easy to mount. For finishing the glazing work, the outer joints are sealed between the glass elements by inserting the joint compound 13.

An important object of the invention is, as stated in the introduction, to make the retaining of the glass elements so flexible that the occurrence of breakage in the glass edge at movements between the glass elements and the supporting frame is not risked. This is especially important with outrigged systems, where one has to take movements, of not only of the glass elements and frame into account, but also of the protruding distance elements. This flexibility is obtained partly by the fact that the attachment elements 12 have the describe design which allows certain angular movements between the attachment element and the glass edge, and partly by the design of the retaining device 23 in which the different included elements may be designed partly with the possibility to move in relation to each other, such as described, and partly in such a way that they have a certain springing ability, such as at the joint between the attachment handles 38 and the axes 43.

It should further be noted, that the placing of the attachment elements along the edges of the module units is of importance for the risk for breakage at the mounting to the glass. At the embodiment shown with said arms, the attachment elements may be provided with the most advantageous placement. As mentioned, it is also possible to let each arm be connected with several attachment elements along the respective edge or arrange several arms, each for one of the occurring attachment elements.

It is also important that the tolerances are kept small between the supporting surface of the supporting element 22 and for the position of the hole in the arm 42 for the axes 43 as well as for the distance between the lower resting surface of the glass element and the position for the attachment elements 12. The keeping of tight tolerances is facilitated by the fact that the organs for support and retaining emanates from the same unit, at the embodiment according to FIG. 3, the head 25.

The invention claimed is:

1. A glazing system for attaching a Façade having top and bottom horizontal edges and a pair of vertical side edges to a building, comprising:

a distance element engaged with a frame of a building;

at least one supporting element attached to said distance element and configured to engage said bottom edge of a portion of said façade so as to secure the vertical load of said façade when the façade is in place on the building, while allowing vertical movement of the façade during the mounting operation thereof, thereby maintaining said façade in an elevated position;

at least one retaining element attached to said distance element by means of an organ member attached to said at least one retaining element in a manner permitting vertical movement of said distance element during mounting of said façade, and a coupling organ attached to said organ member and said distance element, said at least one retaining element being substantially U-shaped and including a coupling organ engagement portion, a waist portion, and a flange portion, wherein said coupling organ engagement portion contacts a surface of said façade proximate to said coupling organ, said flange portion contacts a surface of said façade remote from said coupling organ, and said waist connects said coupling organ engagement portion to said flange portion and is configured to traverse and grip said façade at one of said side edges thereof, thereby preventing movement of said façade in a direction toward or away from a building, and said coupling organ pivotally attached to said organ member about a pivot axis, whereby said façade may be attached to said at least one retaining element before mounting on said distance element for handling said façade from the inside of a building, and said façade may be flexibly retained by said retaining element so as to prevent damage thereto.

2. The glazing system of claim 1, including a connection unit attached to said distance element, said at least one supporting element, and said at least one retaining element.

3. The glazing system of claim 2, further comprising arms, said arms having a first end and a second end, wherein said first end is attached to said connection unit and said second end is attached to said coupling organ, and wherein said connection unit is attached to said distance element, two or more of said at least one supporting elements, and two or more of said at least one retaining elements.

4. The glazing system of claim 2, wherein said coupling organ is operatively engaged with said connection unit, and moveable with respect thereto, whereby the position of said coupling organ can be adapted to correspond to a position of said at least one retaining element during installation of said façade.

5. The glazing system of claim 2, wherein said connection unit is cylindrical in shape and has a first end, a second end, and a side portion, wherein said first end is attached to said distance element, said second end is attached to said at least one supporting element, and said side portion is attached to said at least one retaining element.

6. The glazing system of claim 2, further comprising said façade, comprising a panel having an outer sheet, an inner sheet, a framework connecting said outer sheet to said inner sheet and spanning a distance therebetween, and an elastic insert positioned at a bottom edge of said panel, and wherein said panel is retained in position by said at least one retaining element, and the weight thereof is supported by said at least one supporting element.

7. The glazing system of claim 1, wherein said coupling organ engagement portion and said flange portion of said at least one retaining element each taper away from an opposing surface of said façade at a side edge thereof, thereby defining a void between said façade and said coupling organ engagement and flange portions of said at least one retaining element, and wherein said at least one retaining element is composed of a hard material.

8. The glazing system of claim 7, wherein said flange portion of said at least one retaining element is biased in a direction toward said façade when said at least one retaining element is attached thereto.

9. The glazing system of claim 1, wherein each of said at least one supporting element, said at least one retaining element, and said coupling organ are disposed solely on the interior of said façade for access only from said building.

10. The glazing system of claim 1, including an elastic compound contained within said at least one retaining element for increasing the flexible retention of said façade by said at least one retaining element.

* * * * *